United States Patent [19]

Craycraft

[11] Patent Number: 4,531,742

[45] Date of Patent: Jul. 30, 1985

[54] GOLF GAME APPARATUS

[76] Inventor: Steven R. Craycraft, 3467 Halpern St., Gahanna, Ohio 43230

[21] Appl. No.: 546,880

[22] Filed: Oct. 31, 1983

[51] Int. Cl.[3] ..... A63B 69/36

[52] U.S. Cl. ..... 273/176 F; 273/199 R; 273/DIG. 8; 273/58 F; 434/252

[58] Field of Search ..... 273/199 R, 176 F, 176 FA, 273/176 FB, 176 AB, 176 J, DIG. 8, 58 A, 58 J, 62; 434/252

[56] References Cited

U.S. PATENT DOCUMENTS

| | | | |
|---|---|---|---|
| 1,580,230 | 4/1926 | Brereton | 273/199 R |
| 2,213,013 | 8/1940 | Owen | 273/199 R X |
| 2,364,955 | 12/1944 | Diddel | 273/199 R |
| 2,484,397 | 10/1949 | Barton | 273/199 R |
| 3,601,406 | 8/1971 | Giusti | 273/176 F |
| 3,917,271 | 11/1975 | Lemelson | 273/58 R X |
| 3,940,145 | 2/1976 | Gentiluomo | 273/199 R X |
| 4,201,384 | 5/1980 | Barber | 273/199 R |
| 4,244,576 | 1/1981 | Mosier et al. | 273/199 R X |

*Primary Examiner*—George J. Marlo

*Attorney, Agent, or Firm*—Kremblas, Foster, Millard & Watkins

[57] ABSTRACT

A golf game utilizing a series of incrementally weighted balls with a normal set of golf clubs such that the incremental changes in weight of the balls compensates for the varying changes in angle of the heads of their corresponding golf clubs to yield approximately the same distance in flight. This game contemplates the use of one or more targets for playing a simulated game of golf in which a player uses his normal swing.

11 Claims, 7 Drawing Figures

GOLF GAME APPARATUS

FIELD OF THE INVENTION

This invention relates to a game. More particularly, this invention relates to a golf game played with a normal set of golf clubs, a target, one or more tees, and a set of incrementally weighted golf balls constructed such that players of different hitting abilities or the same player using various clubs will hit a golf ball to approximately the same distance.

BACKGROUND OF THE INVENTION

The game of golf is usually played on a large course and preferrably in good climate. Players of the game frequently desire a means in which they can practice their skills in an indoor format during inclement weather or in a small outside area such as a back yard. The prior art has addressed this problem in numerous ways. In U.S. Pat. No. 3,601,406—Giusti, a back yard golf game is disclosed where the player stands on a mat and drives Velcro ® covered plastic balls at an upright target. The player uses a normal set of clubs and depending upon which club he uses, the ball he hits will either go in a relatively low trajectory or a higher trajectory.

Within this patent various rules exist for determining the equivalent yardage that the player has achieved in hitting the plastic ball as compared to the distance he/she would have hit, had he been playing with a standard golf ball. By doing various computations and following the rules the player can complete an entire game of golf.

Depending on where the ball attaches to the upright target, in the Giusti patent, the player must either move foreward or backward along the fairway in order to adjust for his distance from the hole represented on the upright target. In the reference game, the player is constantly adjusting in his movement to or from the target for the various trajectories of the ball resulting from the use of different clubs. As in an actual game of golf, a ball of constant weight hit by different golf clubs will rise higher or fly further depending upon the club used.

A second approach to help one learn the game of golf without actually having to go to a golf course is addressed by U.S. Pat. No. 4,201,384—Barber. In this patent varying sizes of golf balls, which also vary in weight, are used to teach the game of golf. The patent also contemplates the use of oversized golf clubs. The purpose of the patent is to aid one, particularly the young, the aged, and perhaps even the handicapped to learn the game of golf. This is done by giving them balls that are larger and easier to hit. In this manner they may concentrate more upon their swing in the actual playing of the game, and less upon hitting the ball. This patent is addressed to one learning the game of golf and not to one who is already knowledgeable in the game and desiring to play it in confined spaces or in a small area such as a backyard. Also, the weight changes of the golf balls in this patent are strictly a result of the differences in the size of the balls. The differences in the weights of the balls serves no purpose in their use.

To the knowledge of applicant, the prior art fails to address a means or game in which a golfer, regardless of the club he is using, may remain in one location and hit balls approximately the same distance.

SUMMARY OF THE INVENTION

The invention is a golf game played by a player using substantially constant swings with a plurality of golf clubs having a first series of variances in pitch between their heads. The game also comprises a plurality of balls incrementally weighted in a second series with respect to each other. The series of balls correspond to the variance in pitch of any series of golf clubs. The game may also comprise a tee and at least one target. The relationship is such that when a player hits the balls from the tee with a substantially constant swing, the balls travel in flight at a substantially constant distance to the target.

The current invention includes a plurality of incrementally weighted balls all of substantially the same diameter. In a preferred embodiment the balls are the standard size of a golf ball. The game is also played with a target and one or more tees. The tees may represent varying degrees of turf ranging from a heavy rough, a light rough, and a fairway turf.

A player of this game uses a conventionally standard normal set of golf clubs. The incrementally weighted golf balls are the same diameter as conventionally standard normal sized golf balls, most frequently as described in U.S. Pat. No. 4,201,384 column 1, lines 36 to 41. But when properly selected, the distance each ball travels will be approximately the same. The use of balls weighted, as described below, also permits a big or a short golfer to hit a properly selected series of golf balls the same distance as an average sized golfer. The preferred embodiment of this invention may include a series of as many as twenty or more weighted balls. For players of varying heights and hitting abilities to play this game together, each must known roughly the yardage that he hits a standard golf ball on a normal course with a particular club, such as a driver. The chart supplied with the game will give each player a corresponding series of weighted balls that he is to use with his clubs.

An object of this invention is to give golfers a game that they can play in a confined space or a relatively small outdoor space such as a back yard in which they may use all their standard golf clubs, with balls of normal diameter, and not have to move closer or further away from a target when using a constant swing.

Another object of this invention is to give golfers a game they can play together in which their differences in size on hitting ability is equalized by incrementally weighted balls such that the distance travelled by all the balls they hit will be approximately the same.

Other features and objects of the invention will be apparent from the following drawings and description, as well as the appended claims.

Figure 1:
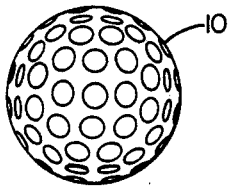
FIG. 1 is a plan/elevation view of a golf ball of normal diameter to be used in this invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION OF THE INVENTION

The preferred embodiment of this invention is for use with a series of conventionally standard golf clubs. Within such a standard set, individual golf clubs vary in the loft or pitch of their heads as well as their length. Chart I below lists the clubs with their respective loft, average shaft length, and the average distance that a standard ball will travel. The loft of a club refers to the number of degrees on the angle that the hitting surface of a club varys from being perpendicular to the ground when in an operable position. The specific degrees of loft are standard and normal at this point in time, but may be revised in the future.

CHART I

| CLUB Number/ Name | LOFT Degrees | AVE. LENGTH Inches | AVERAGE DISTANCE Yards |
|---|---|---|---|
| No. 1 Wood/Driver | 10–12 | 43.5 | 220 |
| No. 3 Wood/Spoon | 16–18 | 42.5 | 210 |
| No. 4 Wood/Cleek | 19–21 | 42.0 | 200 |
| No. 5 Wood/Baffy | 22–24 | 41.5 | 190 |
| No. 2 Iron/Mid Iron | 20 | 38.5 | 180 |
| No. 3 Iron/Mid Mashie | 23 | 38.0 | 170 |
| No. 4 Iron/Mashie Iron | 27 | 37.5 | 160 |
| No. 5 Iron/Mashie | 31 | 37.0 | 150 |
| No. 6 Iron/Spade Mashie | 35 | 36.5 | 140 |
| No. 7 Iron/Mashie Niblick | 39 | 36.0 | 130 |
| No. 8 Iron/Lofter | 42 | 35.5 | 120 |
| No. 9 Iron/Niblick | 47 | 35.0 | 110 |
| Pitching Wedge | 54 | 34.5 | 90 |
| Sand Wedge | 58 | 34.5 | 70 |

Figure 1A:
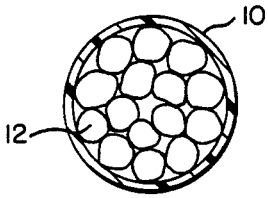
FIG. 1A is a plan/elevation view of a cross-section of a lightly weighted ball showing a small amount of filler such as foam on the inside of the ball.

FIG. 1 illustrates an embodiment of a ball 10 preferrably the size of a selected normal/standard golf ball for use in this invention. This ball 10 can be made of plastic or any other suitable material. FIG. 1A shows the interior of an embodiment of the ball 10 filled with foam particles 12 or other suitable material for varying the weight of the ball. The filler or method chosen to vary the weight of the balls functions best when the weght is distributed equally from the center of the ball. FIG. 1A shows a ball that is light in weight having few foam particles. Such a light ball can be used with a wood driver.

Figure 1B:
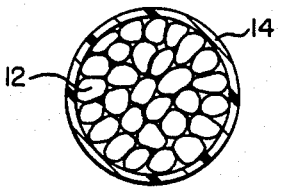
FIG. 1B is a plan/elevation view of a cross-section of a heavily weighted ball showing a large amount of filler such as foam on the inside of the ball.

FIG. 1B shows a ball 14 with a hollow inside cavity that is more densely packed with foam particles 12 or other suitable material. This ball 14 is of a heavier weight than the ball 10 shown in FIG. 1A. If the heavier ball 14 is hit with the same club as that used to hit the ball 10, it will fly further than the ball 10. Therefore, for use in this invention the heavier ball 14, of FIG. 1B, should be used with a shorter distance iron club having a greater degree of pitch on its head. This causes the ball 14 of FIG. 1B, when hit with a short distance iron club, to fly at a higher trajectory but approximately the same distance as the ball 10 in FIG. 1A, when hit with a wood driver.

Figure 2:
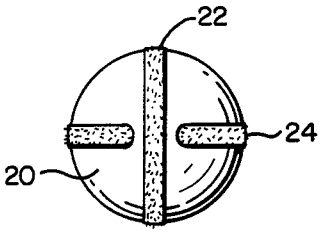
FIG. 2 is a plan/elevation view of an embodiment of a normal size golf ball for use in this invention that has a Velcro ® covering.

FIG. 2 shows an embodiment of a ball for use with this invention when used as part of a game. The ball 20 has strips 22 and 24, attached to its surface and is constructed of a plurality of oblong indentations which adhere to hook-like formations of material. These materials are commonly marketed under the name of Velcro, a registered trademark of the American Velcro Corporation of New York, N.Y. These strips may be fastened directly on the surface of the ball or into a recessed portion of the surface to give the exterior of the ball a smooth, even, and spherical form. The balls disclosed in U.S. Pat. No. 3,917,271—Lemelson, et al., might be useful in the practice of this invention.

Figure 3:
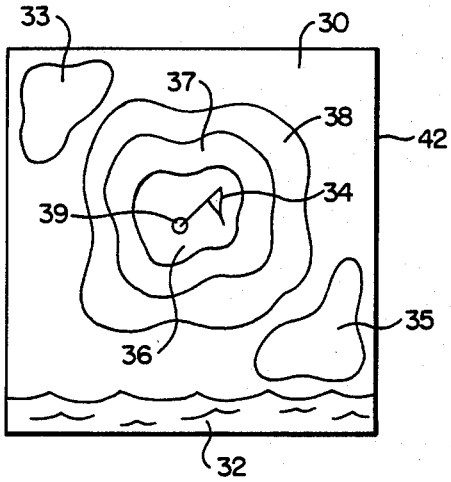
FIG. 3 is a plan view of a proposed target for use with the Velcro ® covered balls employed in this invention.

FIG. 3 illustrates an embodiment of a target 42 on a substrate or mat 30 suitable for use with a ball 20 as illustrated in FIG. 2. The indicia on this target 42 includes a representation of a water barrier 32, sand traps 33 and 35, a flag 34 painted from a spot representing the a hole/cup 39, and circular areas 36, 37, and 38 around that cup representing a green. These circular areas may represent scoring points increasing in number as they get further away from the cup 39.

The closer the player gets his ball to the cup 39, the lower his score. Just as in the game of golf the lower the score, the better the score for the game. Conversely, these circular area may represent distances from the cup 39 requiring one, two, or three putts to get to the cup. For example, when a player places his ball in the first circular area 36, he can consider his ball as being one putt away from the cup. Likewise, when his ball lands in the second circular area 37, he is two putts from the cup or in the third circular area 38, he is three putts from the cup. If his ball lands in the sandtraps 33 or 35, he would have to use his sand wedge with its corresponding ball to take another shot at the cup and hopefully place himself within putting range on the green. If his ball landed in the water barrier 32, he naturally would have to take an additional shot in an attempt to land on the green. If his ball landed on the cup 39, he could consider himself as having placed his ball within the hole and he could begin a new hole of golf.

Figure 4:
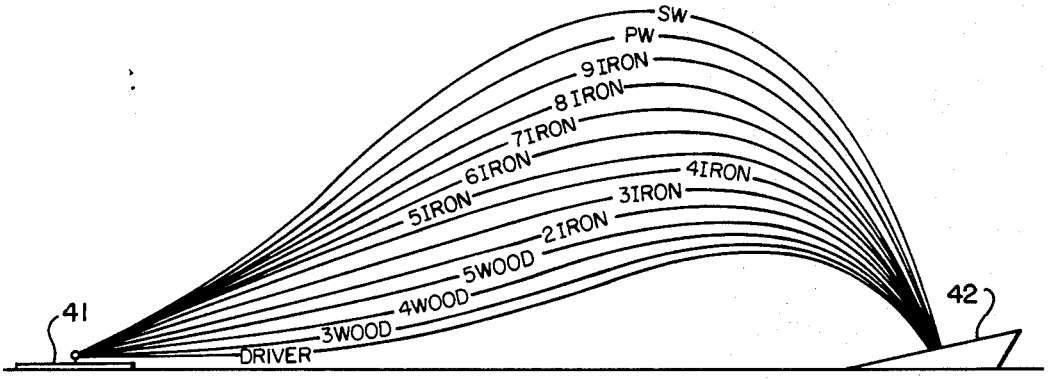
FIG. 4 is an elevation view illustrating the various trajectories encountered with the different incrementally weighted balls between the tee and the target.

FIG. 4 illustrates the various trajectories encountered with incrementally weighted balls as they would appear in relation to one another between a hitting tee 41 and the target 42. Depending upon the particular ball initially chosen to be used with the driver, the distance required between the hitting tee 41 and the target 42 will either be shortened or lengthened. As illustrated, the use of the driver will give the lowest trajectory. The shorter woods and irons have increasing degrees of pitch, which will cause a ball to rise higher into the air. As the balls of increased weight are struck by clubs of increased loft, they fly a higher trajectory, but not a shorter distance. The sand wedge will give the highest trajectory. The lengths of clubs and the pitches of their heads are for the most part standard and predictable. Therefore, the variance in the weight of the balls can also be standardized to yield a predictable trajectory for use with any set of clubs.

It should be noted that the arrangement of the indicia illustrated as obstacles on a target may vary. In fact, this invention is useful with many different targets or even a target made of a net or a basket that could catch or trap non-Velcro covered balls that were hit into it. The use of a target as illustrated causes the invention to be more useful as a golf game. However, a simple, single target allows a golfer to use this invention with all his clubs to perfect his swing.

When approximately twenty balls of incremental weight are supplied to a user of this invention, the selection of the first ball to be used with his driver, will permit him to vary the distance between the hitting tee and the target. The user of this invention will have to determine the distance between the hitting tee 41 and the target 42 by the distance the lightest ball travelled when hit with his driver. The target would be set at that position and the other balls when used with their corresponding club will then land approximately at that point.

Figure 5:
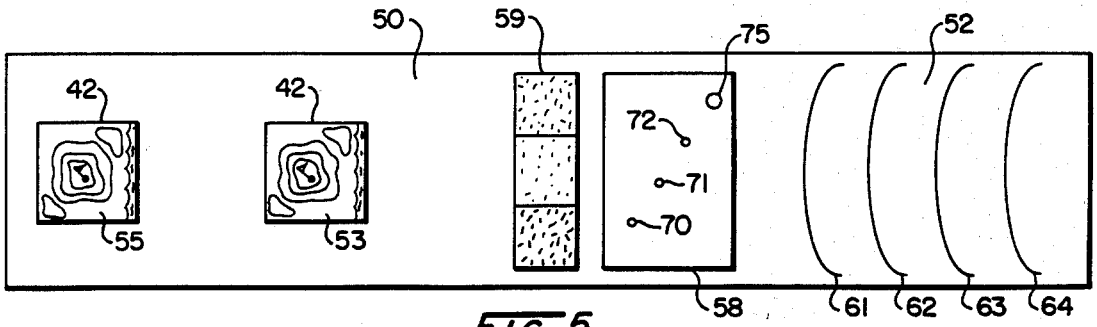
FIG. 5 is a plan view of an embodiment of a substrate or mat for use with this invention including a tee in the center on which one can hit balls to one side of the mat and simulate a driving range, or use both sides of the mat and simulate a game of golf.

FIG. 5 shows a preferred embodiment of a game surface for use with this invention. This comprises a substrate 50, which can be the floor or other mat-like material, with one or more tees 59 located at its center. To one side the player has a plurality of distance lines 61, 62, 63, and 64 marked off on the fairway 52 corresponding to yards from the tee 59. In this direction the player has a simulated driving range. When using this side of the mat 50, the player may use any of his clubs with their corresponding ball. If his swing is constant and outside variables, such as wind, remain the same, he will consistently place a ball at approximately the same distance from the tee 59. However, the purpose of a driving range is to allow one to use his driver so that he may perfect his swing to achieve a greater accuracy. A palyer using this side of the arrangement on the substrate 50 will most frequently be using his woods. The purpose of the various yardage markers is to allow him to gage his improvement in driving a golf ball. In this case he will be using the same ball with the same club all the time.

On the other side of this substrate 50 there are two targets 42 represented by greens 53 and 55. The green 53 closest to the hitting tee 59 is for use with half wedge shots, while the green 55 farthest away from the hitting tee 59 is for full shots made with woods or irons. Each of these greens may have the same indicia obstacles represented upon them. They may be for use with Velcro balls as pictured in FIG. 2 or other suitable balls that will remain in place when they land on a green. It should be noted that the indicia of the substrate 50 need not be presented in only this arrangement or in two directions from the tee 59 in order to carry out this invention. The indicia may be presented all to one side of the tee, if desired.

This half of the substrate 50, in conjunction with the driving portion of the substrate 50, permits a player to simulate an entire game of golf. Holes of varying distances may be issued on cards or other materials included with the game. Upon drawing a score card, a player will be given information on how far he is from the hole and the number of strokes to make par for the hole. He then uses his driver to make a shot from the hitting tee 59 towards the distance lines 61, 62, 63, and 64 on the first half of the substrate 50. The player then determines from the distance lines on the fairway 52, how close his shot put him to the green. The distance lines on the fairway 52 are curved so that off center shots are credited as being further from the green than a shot travelling the same distance down the center of the fairway 52. The player would then select an iron sufficient to make a shot of the distance remaining to the hole. The shot with the iron would be made from the hitting tee 59.

The hitting tee 59 is made of materials of different textures to simulate the turf of the fairway or rough. The player's shot, using an iron, will be made from the fairway turf if his drive shot landed in the middle portion of the fairway 52. The rough turf portion of the hitting tee 59 is used when the player places his drive shot to the sides of the fairway 52. Regardless of the turf used on the hitting tee 59, the subsequent iron shot will be made with a full swing and is aimed at the furthest green 55 from the hitting tee 59.

At this point the ball should have landed on some part of the green 55. If it did not, an additional shot from the hitting tee must be made. If the ball landed in the outer portion of the green 55, the player must make a half wedge shot to get onto the green. To make a half wedge shot the player will be using only half a swing with his club. Since only half a swing will be used, the green 53 at half the distance from the hole is used to play this shot. In this manner a game of golf may be played with this invention in which less than full swings are made to simulate conditions of being near, but not on, the green.

At this point the player's ball should be on a green within one of the circular areas 36, 37, or 38 described in FIG. 3. The player may use these areas to compute the number of putts it will take to hit the ball into the cup. An alternative to this is to provide a putting area 58 on substrate 50. The circular areas about the hole may be represented by distance markers 70, 71, and 72 from the hole 75 on the putting area 58 that the player must place his ball. In this embodiment, a player may use his putter in the game. Undulated surfaces may be used on this green.

Embodiments of this invention may include a target 42 or a substrate 50 which has its indicia of obstacles presented upon it by a projection means such as a photographic slide. In such an embodiment the player can play an entire golf course from a single substrate with different views of greens and obstacles on each hole. In this manner obstacles from famous golf courses could be presented to the player.

Chart II below is an embodiment of a chart for use with either the target, as shown in FIG. 3, or the driving range, as shown in FIG. 5.

CHART II (W = Wood, I = Iron)

| INCREMENTED WEIGHT RATIO | YARDAGE HIT ON REGULAR GOLF COURSE | CLUBS FOR A LARGE HITTER | CLUBS FOR AN AVERAGE HITTER | CLUBS FOR A SMALL HITTER |
|---|---|---|---|---|
| 0.5 | 260 | Driver | | |
| 1.0 | 250 | 3W | | |
| 1.5 | 240 | 4W | | |
| 2.0 | 230 | 5W | | |
| 2.5 | 220 | 2I | Driver | |
| 3.0 | 210 | 3I | 3W | |
| 3.5 | 200 | 4I | 4W | |
| 4.0 | 190 | 5I | 5W | |
| 4.5 | 180 | 6I | 2I | Driver |
| 5.0 | 170 | 7I | 3I | 3W |
| 5.5 | 160 | 8I | 4I | 4W |
| 6.0 | 150 | 9I | 5I | 5W |
| 6.5 | 140 | | 6I | 2I |
| 7.0 | 130 | PW | 7I | 3I |

CHART II-continued (W = Wood, I = Iron)

| INCREMENTED WEIGHT RATIO | YARDAGE HIT ON REGULAR GOLF COURSE | CLUBS FOR A LARGE HITTER | CLUBS FOR AN AVERAGE HITTER | CLUBS FOR A SMALL HITTER |
|---|---|---|---|---|
| 7.5 | 120 | | 8I | 4I |
| 8.0 | 110 | | 9I | 5I |
| 8.5 | 110 | | | 6I |
| 9.0 | 90 | | PW | 7I |
| 9.5 | 80 | | | 8I |
| 10.0 | 70 | | | 9I |
| 10.5 | 60 | | | |
| 11.0 | 50 | | | PW |

As can be seen, the proportioned weights of the balls are shown in the first column. It is believed that the formula to derive these weights places the weight of a particular ball equal to the sine of the angle of the pitch or loft of a selected the head of the corresponding club multiplied by the mass of a ball of normal/standard weight. The equivalent yardage of a ball hit with a driver is shown in the second column. Columns 3, 4, and 5 are designed to start large, average, or small hitters, respectively, on an equal basis. These columns direct a larger more powerful players to use a ball of relative weight 0.5 weight his driver. An average sized player will begin with a ball of relative weight of 2.5 and a small player will use a ball of 4.5 relative weight with his driver. Each player will then go down the chart in matching his shorter clubs with their respective incrementally weighted balls. In this manner each player's ball will land at approximately the same distance from the hitting tee, as shown in FIG. 4. If a player knows the distance that he drives a normal golf ball with a driver, he can find that yardage in column 2 and begin play with the corresponding weighted ball in column 1. This will place him on an equal basis with other players not competitively, but in the distance their golf balls travel in flight. Differences in ability between players may be adjusted by adding or subtracting strokes to their scores based upon their handicaps as in a normal game of golf.

In another embodiment, a miniature or "mini" golf course can be set up based upon this invention. A mini golf course will not take up an area much larger than that currently used in a miniture golf course. Each hole will be based upon the concept demonstrated with the use of the substrate 50 of FIG. 5. A player can go to the first hole and it will have a mat that had greens with different obstacles. He can draw a card or a sign can be present equating the yardage he drives a normal golf ball to the first weighted ball in the series of balls that he is to use on that hole. The player can then play an entire hole from that single tee using any of the clubs necessary to complete that hole. Each subsequent hole will present greens with different obstacles and number of swings required to make par for those holes.

The use of this invention as a driving range will help schools with indoor field houses or gymnasiums to instruct students throughout the year on golfing techniques. This invention with the mat, as illustrated in FIG. 5, or with a target as illustrated in FIG. 3, can be used indoors throughout the year to instruct the basics of golf. A student will have the opportunity of learning the use and the feel of all the clubs in the bag, but yet not require the amount of space traditionally needed to use those clubs. Secondly, the use of this invention indoors allows students to aim at targets with detailed obstacles. This will cause a student to develop to a greater skill level and will require a greater degree of concentration than hitting balls against a tarp.

An additional benefit of this invention is that a player can observe the pattern and trajectory of flight of the balls of the invention. Improper swings with this invention will yield hooks and slices in the flight of the balls. This gives the player immediate feedback on the result of his swing, the same as if he were playing a real game of golf.

While certain preferred embodiments of the present invention have been disclosed in detail, it is to be understood that various modifications in its structure may be adopted without departing from the spirit of the invention or the scope of the following claims.

What is claimed is:

1. Apparatus for a golf game played by a player using a substantially constant swing with a plurality of golf clubs having different degrees of loft on the angle of the hitting surface, varying from one club to the next, in a first series, between their hitting surface, comprising:

a. a plurality of balls all of substantially the same size incrementally varying in weight one to the next in a second series with respect to each other, the differences in weight of the balls in the second series being such that each ball may be driven the same distance, by a golfer using a substantially contant swing executed with substantially the same force, using selected ones of said differently lofted clubs of said set.

2. The apparatus of claim 1 wherein the incrementally weighted balls vary in weight in proportion to the sine of the angle of pitch of a selecteld corresponding club multiplied by the mass of a normal golf ball.

3. The apparatus of claim 1 further comprising:

b. a tee; and c. at least one target.

4. The apparatus of claim 3 wherein the incrementally weighted balls are constructed to be anchored to the target after the target is struck.

5. The apparatus of claim 3 including a projection means for projecting an indicia of obstacles on the target.

6. The apparatus of claim 3 wherein the incrementally weighted balls have a fastening material material applied to their surface and the target is made of a material to which said fastening material will attach.

7. The apparatus of claim 3 wherein the tee includes a plurality of textured materials to simulate different turfs.

8. The apparatus of claim 3 further comprising:

d. a chart having indicia equating the series of incrementally weighted balls to distances that the player drives a standard ball.

9. The apparatus of claim 3 wherein the one or more targets and the tee are on a substrate.

10. An apparatus for a golf game according to claim 9 wherein the substrate has two targets, in which one is used with full swing shots and the second is used with half-swing shots.

11. An apparatus for a golf game according to claim 9 wherein the substrate includes a surface upon which indicia representing a driving range is included for use with the incrementally weighted balls, the driving range having a plurality of distance lines equating approximately to distances that a normal golf ball will travel if hit with an equal swing.

* * * * *